US006705549B2

(12) United States Patent
Nakamura

(10) Patent No.: US 6,705,549 B2
(45) Date of Patent: Mar. 16, 2004

(54) CONSTANT FLOW APPARATUS

(75) Inventor: Kenji Nakamura, Tokyo (JP)

(73) Assignee: Shodensha Corporation, Ltd., Tokyo (JP)

( * ) Notice: Subject to any disclaimer, the term of this patent is extended or adjusted under 35 U.S.C. 154(b) by 0 days.

(21) Appl. No.: 10/153,168

(22) Filed: May 22, 2002

(65) Prior Publication Data

US 2003/0006315 A1 Jan. 9, 2003

(30) Foreign Application Priority Data

May 25, 2001 (JP) ..... 2001-157122

(51) Int. Cl.[7] ..... B05B 1/34

(52) U.S. Cl. ..... 239/533.1; 239/590; 239/553; 239/553.5; 239/428.5

(58) Field of Search ..... 239/590, 590.5, 239/575, 462, 553, 553.5, 590.3, 428.5, 533.1

(56) References Cited

U.S. PATENT DOCUMENTS

| | | | | | |
|---|---|---|---|---|---|
| 2,316,832 | A | * | 4/1943 | Aghnides | 239/428.5 |
| 3,138,177 | A | * | 6/1964 | Cutler | 138/46 |
| 3,321,140 | A | * | 5/1967 | Parkison et al. | 239/428.5 |
| 3,334,818 | A | * | 8/1967 | Moen | 239/428.5 |
| 3,630,444 | A | * | 12/1971 | Nelson | 239/29 |
| 3,664,589 | A | * | 5/1972 | Jatho et al. | 239/428.5 |
| 4,119,276 | A | * | 10/1978 | Nelson | 239/590.3 |
| 4,730,786 | A | * | 3/1988 | Nelson | 239/590.3 |
| 4,760,957 | A | * | 8/1988 | Rosenberg | 239/222.17 |
| 4,800,925 | A | * | 1/1989 | Yeoman | 138/46 |
| 4,917,308 | A | * | 4/1990 | Manhardt et al. | 239/590 |
| 5,779,099 | A | * | 7/1998 | D'Andrade | 222/79 |
| 6,027,044 | A | * | 2/2000 | Hirata | 239/428.5 |
| 6,290,149 | B1 | * | 9/2001 | Daniel et al. | 239/590 |
| 6,484,953 | B2 | * | 11/2002 | Freier | 239/461 |

FOREIGN PATENT DOCUMENTS

| | | | |
|---|---|---|---|
| JP | 2-9906 | 1/1990 | G05D/7/01 |
| JP | 11-270743 | * 10/1999 | F16K/47/02 |

OTHER PUBLICATIONS

Partial Translation of Japanese Application No. 2–9906, filed Jan. 23, 1990, 1 page.

* cited by examiner

*Primary Examiner*—Henry Bennett
*Assistant Examiner*—Amanda Flynn
(74) *Attorney, Agent, or Firm*—Rosenthal & Osha L.L.P.

(57) ABSTRACT

A constant flow apparatus for adapting a fluid flow passing through a pipe at constant value comprises a tubular body to be mounted inside the pipe, an orifice disposed at the output end side of the tubular body, a movable needle with a flat tip portion positioned opposite the orifice, a spring supporting the needle with appropriate elastic force, and an elastic tubular sealing member having a circumferential bulging portion provided on the outside of the tubular body to cover the tubular body. The constant flow apparatus can be fixedly mounted in the pipe irrespective of the diameter of the pipe, and adapt the fluid flow passing through the pipe, preventing the needle from vibration.

11 Claims, 7 Drawing Sheets

FIG. 6a
FIG. 6b
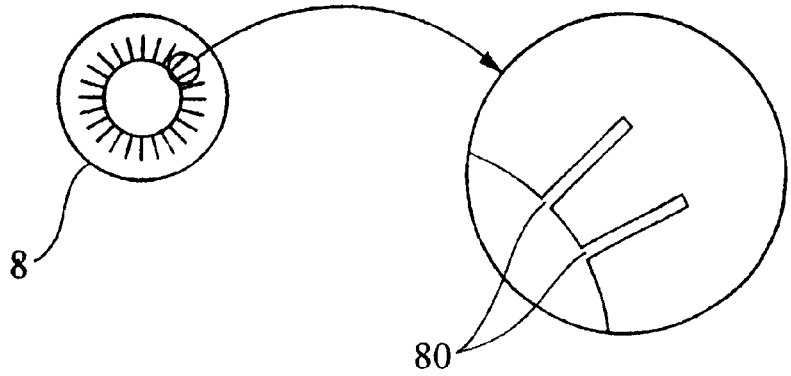
FIG.7
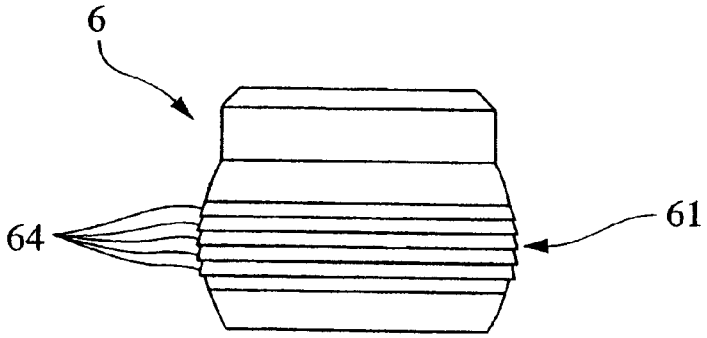
FIG.8
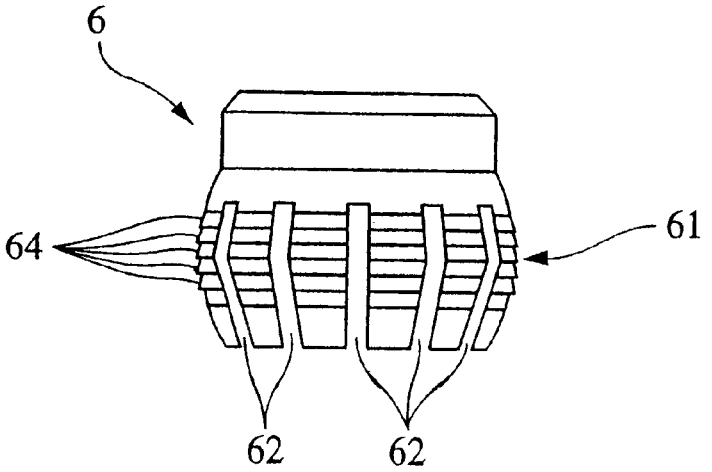

CONSTANT FLOW APPARATUS

BACKGROUND OF THE INVENTION

1. Field of the Invention

The present invention relates to a constant flow apparatus, and in particular relates to an improvement of the needle portion which undergoes a changing movement in response to the pressure of a fluid, and an improvement of the arrangeability for the fluid flow route in order to maintain the passing flow at a constant value.

2. Description of the Prior Art

In the water supply equipment of buildings such as hotels or the like for example, lavatories and showers are simultaneously used with ease at many locations. Now, because there is a concentrated demand for water supply, there is the problem that the water pressure becomes lowered, whereby the amount of water discharged by each water faucet is reduced. Further, as for the water supply equipment, the water supply pressure is set sufficiently high to ensure water supply to the end of the piping system. For this reason, in general when a water faucet is turned on, there is a tendency for water to gush out at an excessive discharge rate.

As a countermeasure in this regard, a constant flow apparatus has been proposed in which an appropriate amount of water is discharged at the output side without being affected by pressure changes of the input side. For example, Japanese Laid-Open Utility Model Application No. HEI 2-9906 discloses an apparatus in which an orifice is provided inside a tubular body, and a needle which is supported by a spring is arranged to face the orifice, wherein the needle position moves in response to the pressure of the fluid, whereby a constant flow operation that maintains the discharge amount at an appropriate value is carried out.

However, in the apparatus disclosed in Japanese Laid-Open Utility Model Application No. HEI 2-9906, it has been determined by experimental analysis that when there are pressure changes at the input side, it is easy for vibrations to arise in the needle, and there is the fear that such vibrations will increase and become unstoppable. Further, improvements have been sought due to fact that the vibrations of the needle generate noise and make discharging unstable.

As for the problems described above, it is inferred from experimental analysis that there is a relationship with the shape of the tip portion of the needle. Namely, in the published apparatus described above, from the fact that the tip portion of the needle is given a conical shape, the flow of the fluid will definitely form a laminar flow type state at the output side which passes the orifice. Such flow will flow while exhibiting a pulling force on the needle which is balanced by the elastic force of the spring. At this time, when there are pressure changes at the input side, the needle moves in response to such changing forces, but the needle moves too much because of the strong pulling force due to the flow at the output side discharged from the orifice. Accordingly, the spring exhibits a repulsive force which creates mutual interference, and for these reasons it is easy for vibrations to arise in the needle, and such vibrations can increase and become unstoppable.

On the other hand, with regard to a pipeline provided with a constant flow apparatus, there are many types with regard to thickness and diameter thereof, but in the meter system and the inch system for example, when there is only a small difference in the inside diameter, such items are roughly the same. However, even in such case, the prior art establishes the outside diameter of the constant flow apparatus to correspond to each pipeline, but when the mounting diameter does not match, the constant flow apparatus can not be made to function normally. For this reason, exclusive products for each of such pipelines need to be produced, and this creates the problem of high cost.

SUMMARY OF THE INVENTION

In view of the background described above, it is an object of the present invention to solve the problems described above by providing a constant flow apparatus which makes it possible to prevent abnormal excessive flows and noise by preventing vibration of the needle which carries out a constant flow operation to maintain the passing flow at a constant value, which carries out a discharge operation in a highly stable manner to maintain the passing flow at a constant value, and which makes it possible for mounting to be carried out in a proper state even when there is a slight difference with the pipeline diameter of the fluid flow route.

In order to achieve the object stated above, the constant flow apparatus according to the present invention is mounted in the flow route of a fluid to maintain the passing flow at a constant value, and is equipped with a tubular body which is fitted and mounted inside a pipeline forming the flow route, an orifice provided at the output end side of the tubular body, a movable needle arranged to face the orifice, and a spring which supports the needle positioned to face the orifice by an appropriate elastic force, wherein the tip portion of the needle is formed to have a flat surface.

Further, the constant flow apparatus is also equipped with an axial rod provided at the input end side of the tubular body, and a cylinder hole provided in the needle to receive the axial rod, wherein the fitting of the axial rod into the cylinder hole carries out a dampening operation which serves as a dampening means for dampening changing movement of the needle.

Further, the constant flow apparatus is also equipped with an annular sealing plate made from an elastic member such as rubber or the like mounted to an end face portion of the cylinder hole, wherein the inner edge of the annular sealing plate makes contact with the outer periphery of the axial rod fitted therein.

In the present invention, because the tip portion of the needle is formed to have a flat surface, after the flow passes through the gap with the orifice, drag is produced and a vortex is created, whereby the pulling force on the needle does not become very strong and remains weak, and a vibration process like that of the prior art is not reached.

Further, the constant flow apparatus preferably includes a tubular sealing member made from an elastic member such as rubber or the like provided on the outside of the tubular body to cover the tubular body, wherein a circumferential convex bulging portion is formed in the tubular sealing member. Further, a plurality of circumferential convex strip portions are preferably formed on the surface of the bulging portion of the tubular sealing member.

On the other hand, a plurality of vertical slits are preferably formed in the side periphery of the tubular sealing member along the axis thereof. In this case, a flow adjustment portion for adjusting the flow of the passing fluid is mounted to the tubular sealing member to cover the output end side of the tubular body, and the flow adjustment portion is provided with a plurality of slots or vertical slits which run along the axis.

Now, because the tubular sealing member formed from an elastic member such as rubber or the like has a circumferential convex bulging portion formed on the side periphery thereof, the bulging portion can be easily indented to make it possible for fitting to be carried out for pipeline inside diameters in the range from the diameter of the peak portion of the bulging portion when the peak portion is indented to a moderate degree to the diameter of the peak portion when it is almost completely indented.

Further, an outside flange portion is preferably provided at the input end side of the outside of the tubular body. In this way, for example, when the constant flow apparatus of the present invention is installed at a connecting portion of a pipeline which forms an existing water route so that the constant flow apparatus is inserted from both sides, the tubular body is inserted into the inside of the pipeline, and the outside flange portion is held between pipes on both sides. Accordingly, because the outside flange portion is the only exposed portion, the total length of the water route is not made that much longer.

BRIEF DESCRIPTION OF THE DRAWINGS

FIG. 6(*a*) is a plan view of an annular sealing plate, and FIG. 6(*b*) is an enlarged view of an essential portion thereof.

FIG. 7 is a side view of the tubular sealing member of FIG. 5.

FIG. 8 is a side view showing another example of a tubular sealing member.

DETAILED DESCRIPTION OF THE PREFERRED EMBODIMENTS

The preferred embodiments of a constant flow apparatus according to the present invention are described below.

Figure 1:
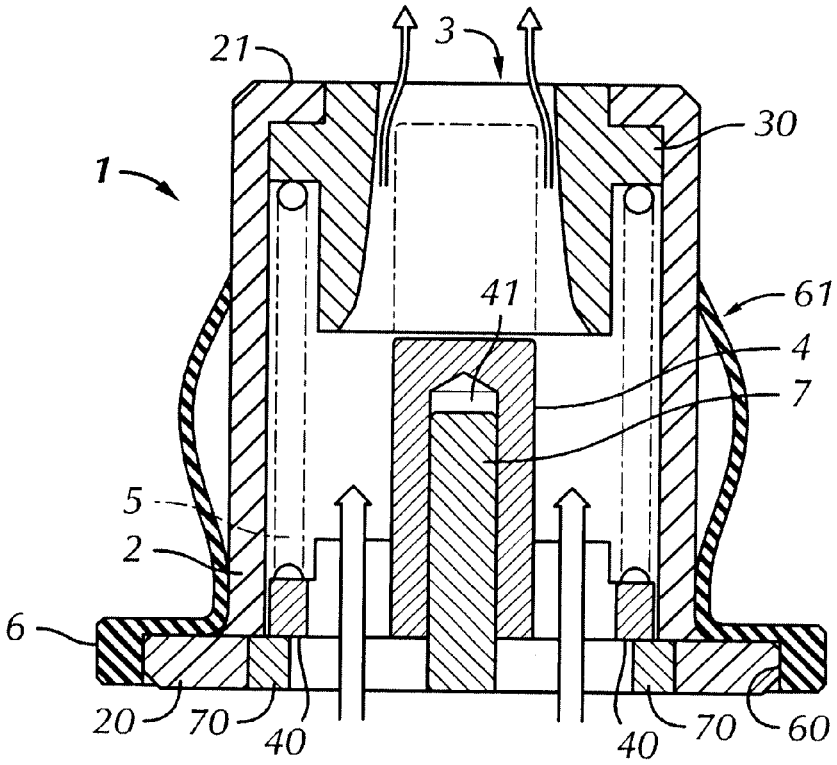
FIG. 1 is a cross-sectional view of a constant flow apparatus showing a first embodiment of the present invention.

FIG. 1 shows a first embodiment of the present invention. In the present embodiment, a constant flow apparatus 1 is arranged in the flow route of a fluid to maintain the passing flow at a constant value. An orifice 3 is provided inside a tubular body 2, and a needle 4 which is supported by a spring 5 is arranged to face the orifice 3. In this way, the position of the needle 4 moves in response to the pressure of the fluid, and this forms a structure which carries out a constant flow operation that maintains the discharge rate at an appropriate value.

The tubular body 2 is formed from a metal material such as stainless steel or the like, a plastic synthetic resin or other high molecular materials, and an outside flange portion 20 and an inside flange portion 21 are respectively provided at the input end side and the output end side. A tubular sealing member 6 is mounted on the outside flange portion 20 to form a cover, and the orifice 3 is held and supported by the inside flange portion 21.

The orifice 3 is formed from a high molecular material such as a plastic or the like. Further, the orifice 3 has a tubular shape in which the inside diameter narrows toward the output side. Furthermore, a convex flange portion 30 is provided on the outer periphery of the orifice 3, and this convex flange portion 30 is held in place by contact with the inside flange portion 21 of the tubular body 2.

The needle 4 is formed to have a cylindrical shape with the tip portion thereof having a flat surface. Further, the end which forms the input end side of the needle 4 forms a ring portion 40 which has a radial rib. Further, the tip portion thereof faces the orifice 3, and at this time the spring 5 is supported between the ring portion 40 and the convex flange portion 30. Furthermore, a cylinder hole 41 fitted with an axial rod described later is formed in the upstream side in the needle 4, and the needle 4 is supported by the fitting with the axial rod 7, whereby a structure which carries out a dampening operation is formed. The needle 4 can also be formed from a plastic synthetic resin or other high molecular material or the like.

Namely, one end of the axial rod 7 forms a mounting ring 70 which has a radial rib, wherein mounting is carried out by fitting into the input end side of the tubular body 2, and at this time, the axial rod 7 is fitted into the cylinder hole 41 of the needle 4. In this way, the fitting together of the axial rod 7 and the cylinder hole 41 functions as a damper to dampen the changing movement of the needle 4.

Figure 2:
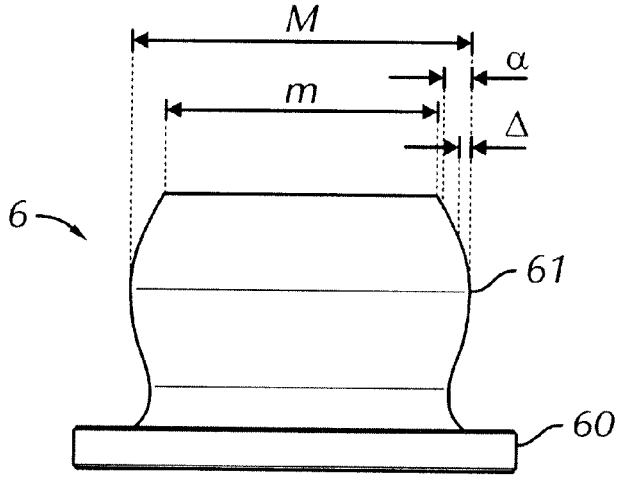
FIG. 2 is a side view of the tubular sealing member of FIG. 1.

The tubular sealing member 6 is formed from an elastic member such as rubber or the like, and as shown in FIG. 2, is formed to have a tubular shape. Further, a step portion 60 which covers the outside flange portion 20 is provided at one end of the tubular sealing member 6, and a circumferential convex bulging portion 61 is formed on the outer peripheral side surface. Accordingly, the insertion of the bulging portion 61 is easy, and fitting can be carried out for pipeline inside diameters in the range from the diameter of the peak portion of the bulging portion 61 when the peak portion is indented to a moderate degree (peak portion diameter M−indentation quantity $\Delta$) to the diameter of the peak portion when it is roughly completely indented (tube diameter m+deformation quantity $\alpha$), whereby the fitting and mounting of the constant flow apparatus 1 is obtained.

Figure 3:
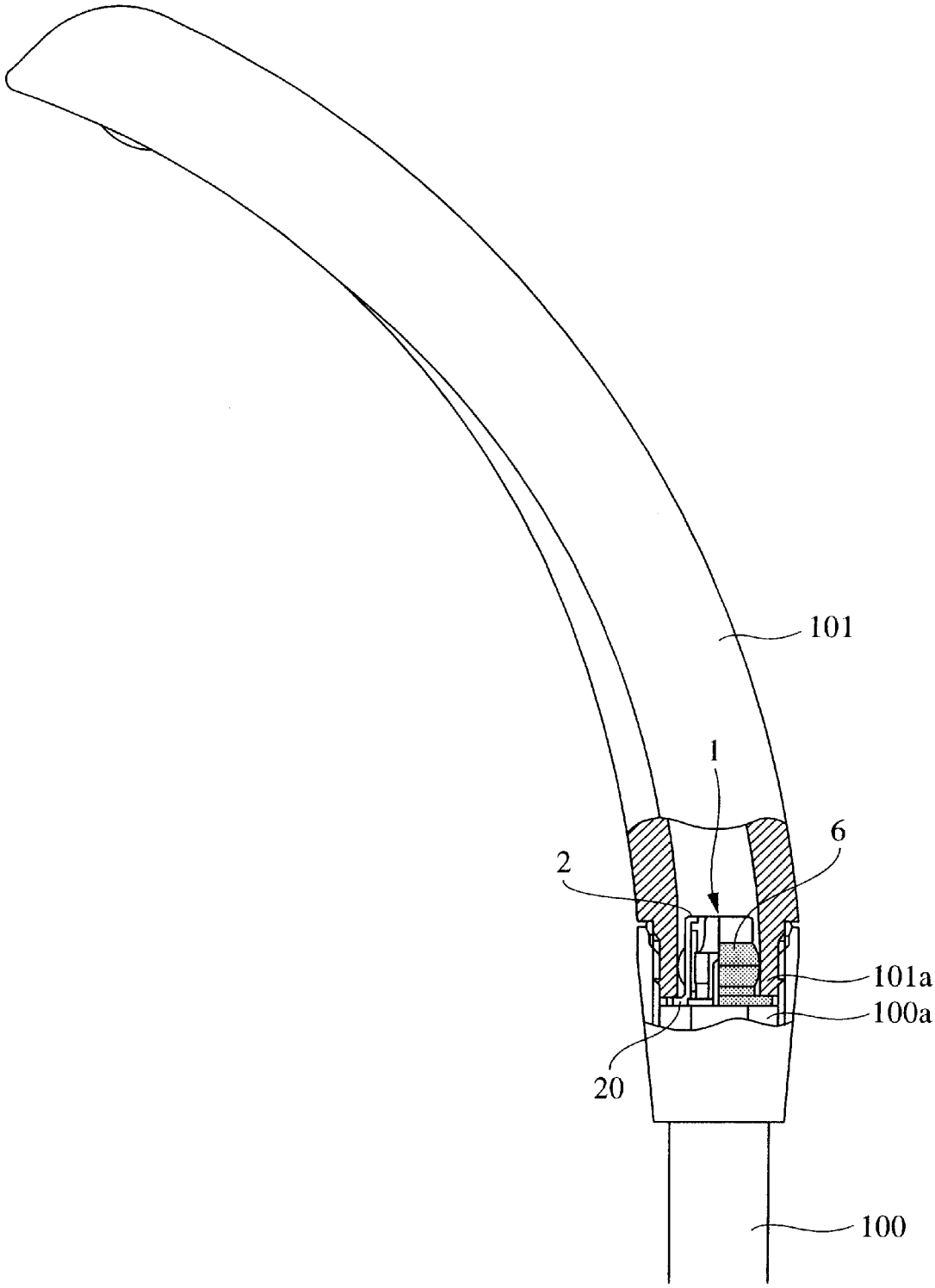
FIG. 3 is a side view showing an application example for a shower head in which the mounting portion is exposed.

Further, FIG. 3 is a side view showing an application example for a shower head 101 in which the mounting portion is exposed. In contrast with the prior art in which an exclusive product having an outer diameter matching the mounting diameter needs to be provided, in the example shown in FIG. 3, a correspondence is possible even when the mounting diameter is large to a certain extent with respect to the outer diameter of the tubular body 2, and it is possible to carry out mounting in a state where leakage from the periphery of the fitting mount is prevented by the tubular sealing member 6.

Moreover, the tubular body 2 of the constant flow apparatus 1 is inserted into the inside of the shower head 101, and the outside flange portion 20 is fixed between a tip 100*a* of a hose 100 and a base end 101*a* of the shower head 101. Accordingly, movement of the constant flow apparatus 1 is restrained, and mounting is carried out at a prescribed position. In this example, in the case where the constant flow apparatus 1 is mounted in existing shower equipment not provided with the constant flow apparatus 1, because there is almost no difference in the tip position of the shower head 101 with respect to the tip 100*a* of the hose when compared with the situation before mounting except for the thickness portion of the outside flange portion 20, the same feel of use up to now can be obtained. In other words, the constant flow apparatus 1 can be mounted with almost no exposure to the outside.

Figure 4:
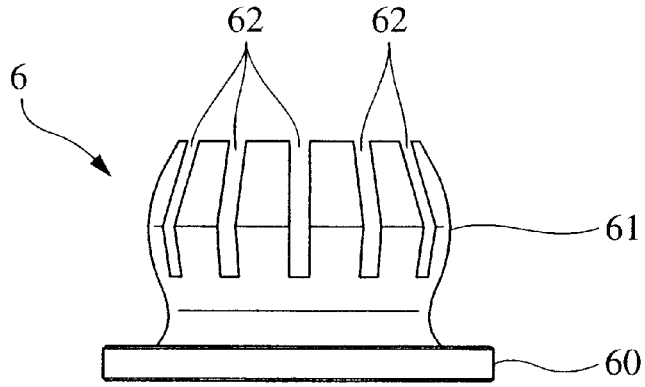
FIG. 4 is a side view showing another example of a tubular sealing member.

Further, as shown in FIG. 4, a plurality of vertical slits 62 may be formed in the side periphery of the tubular sealing member 6 along the axis. In this case, because the bulging portion 61 is divided by the vertical slits 62, the bulging portion 61 can be indented by a weaker force, and this makes it easier to fit into the pipeline for mounting.

The fluid (e.g., water) flows in from the mounting ring 70 side, and pushes the ring portion 40 of the needle 4. Accordingly, the needle 4 undergoes changing movement in response to the pressure of the fluid, and this causes the tip portion of the needle 4 to penetrate the orifice 3 while the fluid flows out through the gap therebetween, whereby the passing flow discharging rate is maintained at a constant value. In this regard, because the tip portion of the needle 4 is formed to have a flat surface, after the flow passes through the gap with the orifice 3, drag is produced and a vortex is created, whereby the pulling force on the needle does not become very strong. Accordingly, a vibration process like that of the prior art is not reached, and this makes it possible to prevent vibration of the needle 4. As a result, it is possible to prevent abnormal excessive flow and noise, and the discharging operation that maintains the passing flow at a constant value can be carried out in a highly stable manner.

Further, in the case where each structural member is made from plastic or the like, because there will be no corrosion due to the fluid water even when mounted inside a shower head or inside some other pipeline, after being mounted once, the constant flow apparatus 1 can be used as is over a long period of time. Consequently, maintenance becomes easy.

Figure 5:
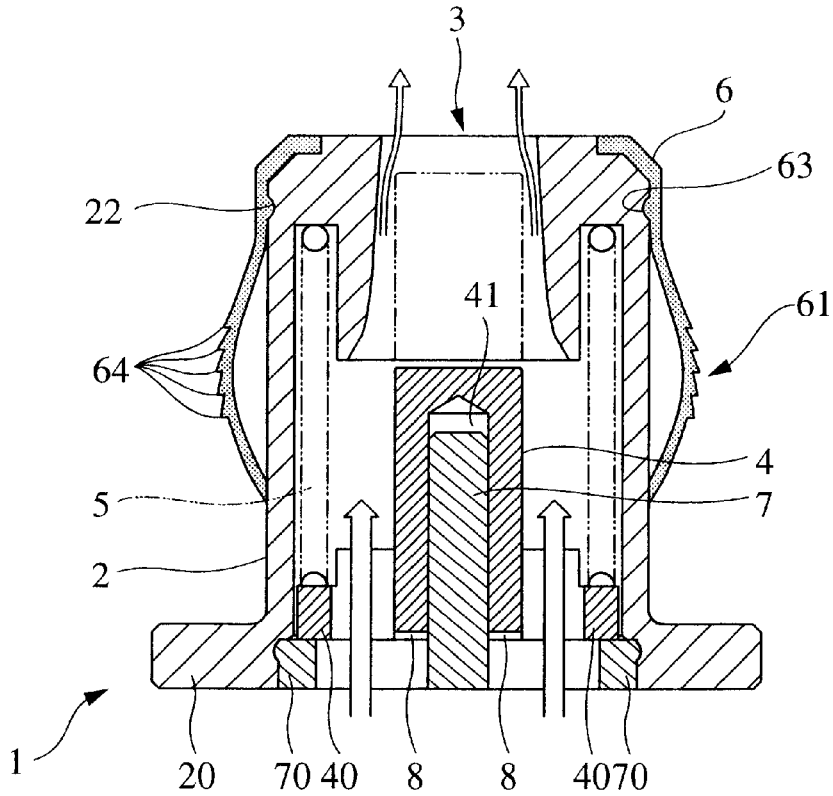
FIG. 5 is a cross-sectional view of a constant flow apparatus showing a second embodiment of the present invention.

FIG. 5 is a cross-sectional view showing a second embodiment of a constant flow apparatus according to the present invention. In the present embodiment, the tubular body 2 and the orifice 3 are integrally formed, the tubular sealing member 6 is mounted at the output end side of the tubular body 2 to form a cover, and an annular sealing plate 8 is mounted to the cylinder hole 41 of the needle 4.

Namely, the tubular body 2 is formed from a high molecular material such as plastic or the like, and a structure is employed in which the tubular body 2 and the orifice 3 are integrally formed. Further, a circumferential groove 22 is provided in the outer periphery of the output end side of the tubular body 2, and a convex strip 63 corresponding to this is formed in the inner periphery of the tubular sealing member 6, whereby the tubular sealing member 6 is mounted to form a cover by fitting the convex strip 63 into the circumferential groove 22.

The annular sealing plate 8 is formed from an elastic member such as rubber or the like, and as shown in FIG. 6, a plurality of slits 80 are provided in the inner edge in the radial direction, and when mounted to the end face portion of the cylinder hole 41, a structure is formed in which such inner edge makes contact with the outer periphery of the axial rod 7 fitted therein.

In this way, because the inner edge of the annular sealing plate 8 makes contact with the outer periphery of the axial rod 7, it is possible to prevent foreign material from entering into the inside of the cylinder hole 41 when the needle 4 undergoes changing movement, and by making it possible to prevent the adhesion of foreign material, cleaning can be carried out. As a result, the changing movement of the needle 4 and the dampening operation due to the fitting of the axial rod 7 in the cylinder hole 41 can be carried out more reliably, and this makes it possible to improve reliability.

Further, as shown in FIG. 7, in the present embodiment, a plurality of circumferential convex strip portions 64 are formed in the surface of the bulging portion 61 of the tubular sealing member 6, and because these convex strip portions 64 push against the inner wall of the pipeline when fitting and mounting, it is possible to increase the frictional resistance, and this makes it possible to achieve a high mounting reliability.

Furthermore, as shown in FIG. 8, a plurality of vertical slits 62 may be formed in the side periphery of the tubular sealing member 6 along the axis, and this is the same as the case of the first embodiment.

Figure 9:
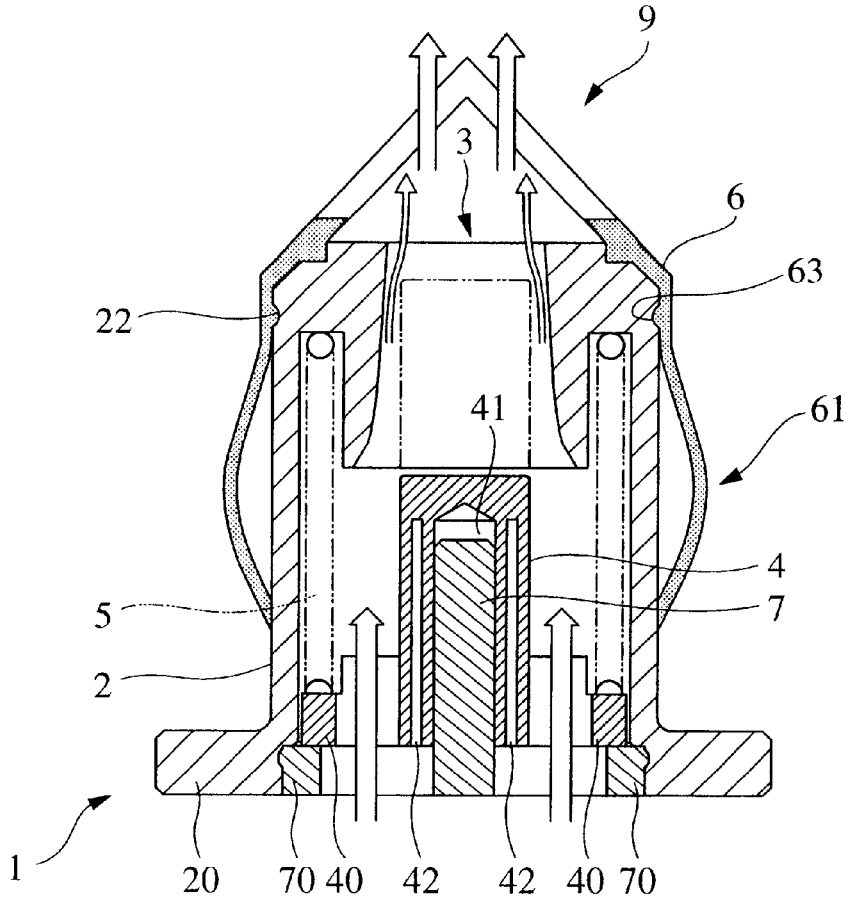
FIG. 9 is a cross-sectional view of a constant flow apparatus showing a third embodiment of the present invention.

FIG. 9 is a cross-sectional view showing a third embodiment of a constant flow apparatus according to the present invention. In the present embodiment, the tubular body 2 and the orifice 3 are integrally formed, and the tubular sealing member 6 is mounted at the output end side of the tubular body 2 to form a cover in the same manner as in the second embodiment. Further, the needle 4 is formed from a high molecular material such as plastic or the like, and a structure is employed in which hollow bored portions 42 are provided inside the needle 4. Further, a flow adjustment portion 9 for adjusting the flow of the passing fluid is mounted to the tubular sealing member 6 to cover the output end side of the tubular body 2.

Figure 10:
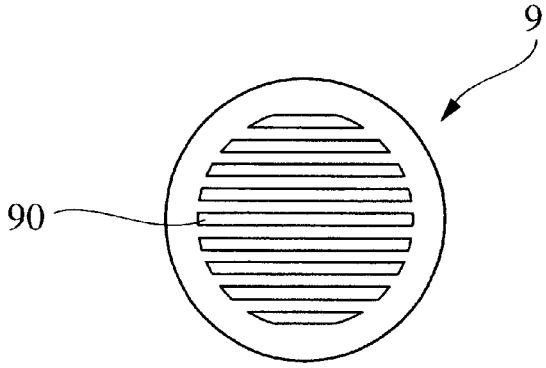
FIG. 10 is a plan view of a flow adjustment portion.
Figure 11:
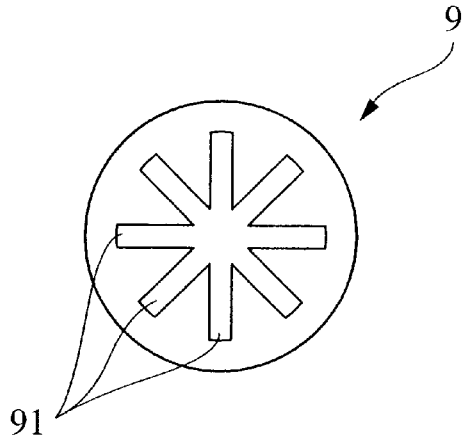
FIG. 11 is a plan view showing another example of a flow adjustment portion.
Figure 12:
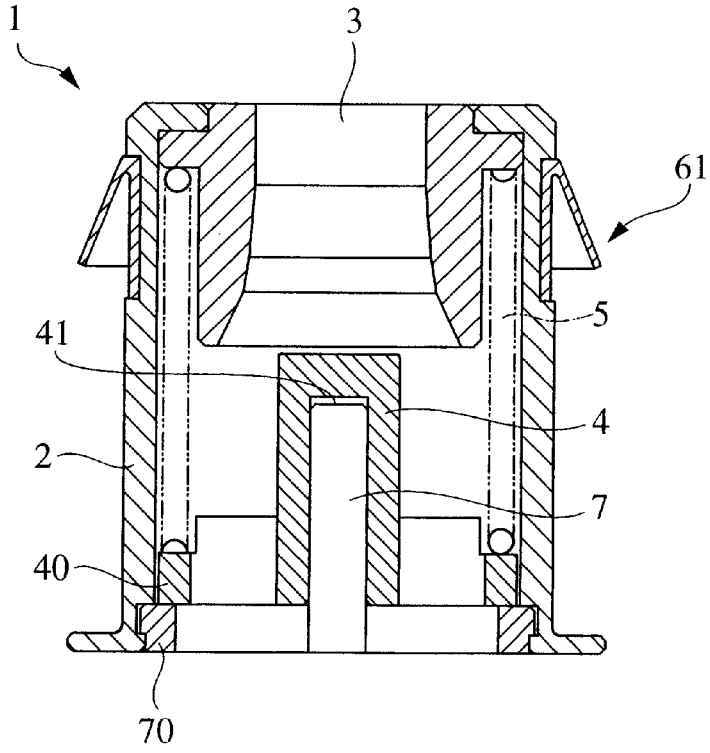
FIG. 12 is a cross-sectional view of a constant flow apparatus showing a fourth embodiment of the present invention.

The flow adjustment portion 9 employs a structure provided with a plurality of slots 90 as shown in FIG. 10, or employs a structure provided with a plurality of vertical slits 91 which run along the axis as shown in FIG. 11. In this way, by mounting the flow adjustment portion 9 at the output side of the orifice 3, it is possible to correct the turbulence of the flow discharged from the orifice 3, and as a result, this has the effect of preventing abnormal excessive flow and vibration.

FIG. 10 is a cross-sectional view showing a fourth embodiment of a constant flow apparatus according to the present invention. In the present embodiment, an orifice 3 is provided inside a tubular body 2, and a needle 4 which is supported by a spring 5 is arranged to face the orifice 3. In this way, the position of the needle 4 moves in response to the pressure of the fluid, and this forms a structure which carries out a constant flow operation that maintains the discharge rate at an appropriate value. Further, in the present embodiment, the tubular sealing member 6 is mounted at the output end side of the tubular body 2. Further, because the other structures and operational effects are the same as those of each of the embodiments described above, the same reference characters are used for corresponding members, and a detailed description thereof is omitted.

Figure 13:
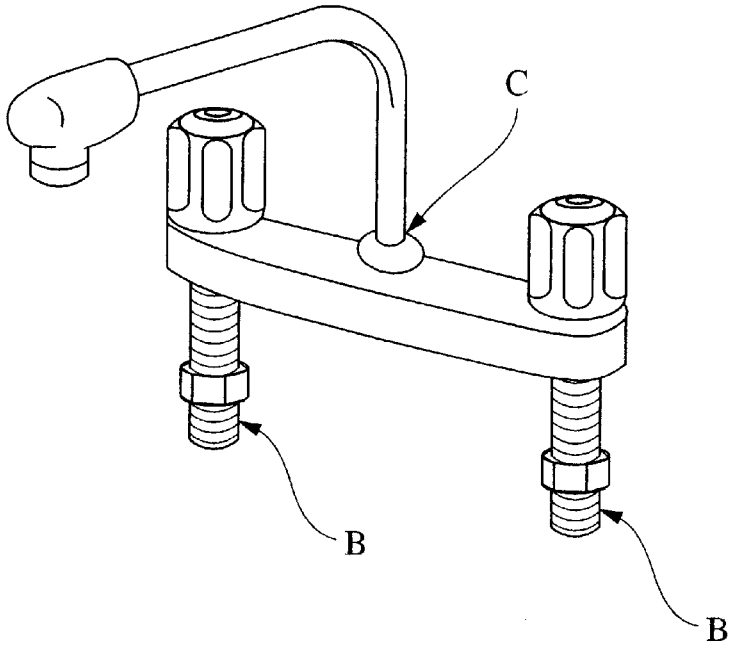
FIG. 13 is a drawing showing an application example for a faucet.
Figure 14:
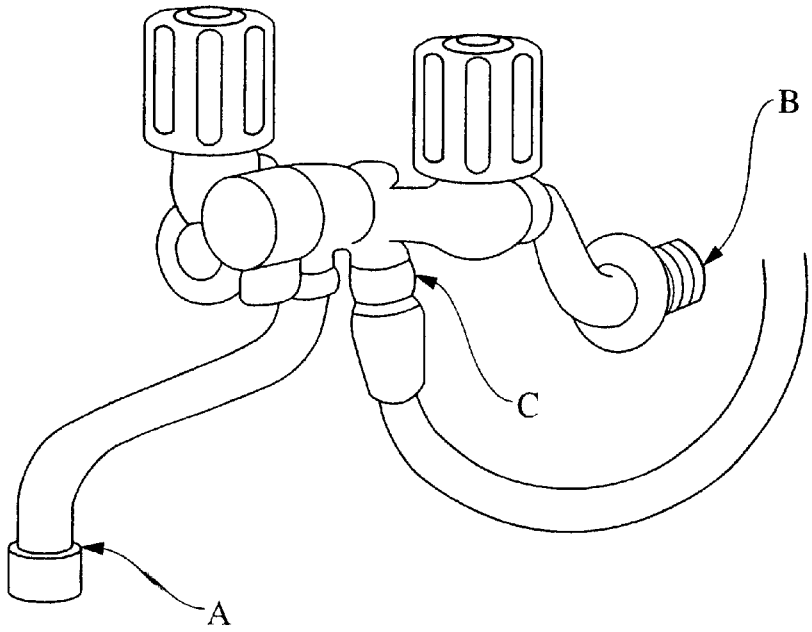
FIG. 14 is a drawing showing an application example for a faucet.

Further, in the examples described above, the example of the mounting location of the constant flow apparatus according to the present invention was shown as a shower head, but the present invention is not limited to this, and it is possible to install the constant flow apparatus midway in the pipeline route of various fluids. For example, as shown in FIG. 13 and FIG. 14, a constant flow apparatus can be installed at each of the joint portions (as shown by the arrows in the drawings) forming a faucet. As is clear from the drawings, a constant flow apparatus may be installed at the tip side (arrow A) such as the discharge opening of the nozzle or the like, at the mounting side (arrow B) of a washstand or wall mount opening, or at an intermediate section thereof (arrow C).

In the case of the faucets shown in the drawings, such faucets can be disassembled easily even when they are existing faucets, and a constant flow apparatus can be installed at a prescribed position. Further, in the constant flow apparatus of the present embodiment, because the total length is expanded only by the thickness of the outside flange portion, the faucet will not protrude in a big way, and mounting can be carried out without a feeling of incongruity.

Furthermore, in the case of faucets exposed to the outside like the faucets shown in the drawings, even for existing pipelines, a constant flow apparatus can be installed later. Further, even for arrangements inside buildings or underground or the like for example, a constant flow apparatus can be installed in advance when laying a pipeline.

Moreover, the use of the present invention can be applied to carrying out constant/appropriate value supply and uniform supply, protection of equipment against excessive flow, and equipment for the purpose of saving water and the like. Further, the concrete use examples are not limited to the shower and faucet described above, and the present invention can be applied to various systems such as a constant flow drainage line of a purification tank, a thawing water line for frozen seafood, a sprinkler line for horticulture, a drainage line of industrial equipment and the like.

As described above, in the constant flow apparatus according to the present invention, because the tip portion of the needle is formed to have a flat surface, after the flow passes through the gap with the orifice, drag is produced and a vortex is created, whereby the pulling force on the needle does not become very strong. Accordingly, a vibration process like that of the prior art is not reached, and this makes it possible to prevent vibration of the needle. As a result, it is possible to prevent abnormal excessive flow and noise, and the discharging operation that maintains the passing flow at a constant value can be carried out in a highly stable manner. Further, because the tubular sealing member formed from an elastic member such as rubber or the like has a circumferential convex bulging portion formed on the side periphery thereof, the bulging portion can be easily indented to make it possible for fitting to be carried out for pipeline inside diameters in the range from the diameter of the peak portion of the bulging portion when the peak portion is indented to a moderate degree to the diameter of the peak portion when it is almost completely indented, whereby the fitting and mounting of the constant flow apparatus is obtained. Namely, in contrast with the prior art in which an exclusive product having an outer diameter matching the mounting diameter needs to be provided, a correspondence is possible even when the mounting diameter is large to a certain extent with respect to the outer diameter of the tubular body, and it is possible to carry out mounting in a state where leakage from the periphery of the fitting mount is prevented by the tubular sealing member.

What is claimed is:

1. A constant flow apparatus comprising:

a tubular body;

an orifice provided at the output end side of said tubular body;

a movable needle having a flat tip portion arranged opposite said orifice; and a spring supporting said needle by an appropriate elastic force;

wherein said tubular body comprises an outside flange portion extended outward from the input end of said tubular body.

2. The constant flow apparatus of claim 1, further comprising an axial rod provided at the input end side of said tubular body, and a cylinder hole provided in said needle to receive said axial rod, such that the fitting of the axial rod into the cylinder hole buffers movement of said needle.

3. The constant flow apparatus of claim 2, further comprising an annular sealing plate made from an elastic member such as rubber or the like mounted to an end face portion of said cylinder hole, wherein the inner edge of said annular sealing plate annular sealing plate made from an elastic member such as rubber or the like mounted to an end face portion of said cylinder hole, wherein the inner edge of said annular sealing plate makes contact with the outer periphery of said axial rod fitted therein.

4. The constant follow apparatus of claim 1, further comprising a tubular sealing member made from an elastic member provided on the outside of said tubular body to cover said tubular body, in the form of a circumferential bulging portion.

5. The constant flow apparatus of claim 4, further comprising a flow adjustment portion for adjusting the flow of the passing fluid mounted to said tubular sealing member to cover the output end side of said tubular body, wherein said flow adjustment portion is provided with a plurality of slots or vertical slits which run along the axis.

6. The constant flow apparatus of claim 4, wherein a plurality of vertical slits are formed in the side periphery of said tubular sealing member along the axis thereof.

7. The constant flow apparatus of claim 6, further comprising a flow adjustment portion for adjusting the flow of the passing fluid mounted to said tubular sealing member to cover the output end side of said tubular body, wherein said flow adjustment portion is provided with a plurality of slots of vertical slits which run along the axis.

8. The constant flow apparatus of claim 4, wherein a plurality of circumferential convex strip portions are formed on the surface of the bulging portion of said tubular sealing member.

9. The constant flow apparatus of claim 8, further comprising a flow adjustment portion for adjusting the flow of the passing fluid mounted to said tubular sealing member to cover the output end side of said tubular body, wherein said flow adjustment portion is provided with a plurality of slots of vertical slits which run along the axis.

10. The constant flow apparatus of claim 8, wherein a plurality of vertical slits are formed in the side periphery of said tubular sealing member along the axais thereof.

11. The constant flow apparatus of claim 10, further comprising a flow adjustment portion for adjusting the flow of the passing fluid mounted to said tubular sealing member to cover the output end side of said tubular body, wherein said flow adjustment portion is provided with a plurality of slots or vertical slits which run along the axis.

* * * * *